US005193925A

United States Patent [19]

Foulke

[11] Patent Number: 5,193,925

[45] Date of Patent: Mar. 16, 1993

[54] FOAM KEYBOARD WRIST SUPPORT AND DUST COVER APPARATUS AND METHOD

[75] Inventor: Robert W. Foulke, San Clemente, Calif.

[73] Assignee: Packaging Industries Group, Inc., Hyannis, Mass.

[21] Appl. No.: 825,951

[22] Filed: Jan. 27, 1992

[51] Int. Cl.[5] ..... B41J 29/00

[52] U.S. Cl. ..... 400/715; 150/165; 248/118; 400/713

[58] Field of Search ..... 400/496, 713, 714, 718, 400/715, 682; 248/118, 118.1, 118.3, 118.5, 918; 271/523, 320, 305; 150/165; 206/44.12, 523

[56] References Cited

U.S. PATENT DOCUMENTS 4,703,161 10/1987 McLean ..... 206/523
4,709,972 12/1987 LaBudde et al. ..... 400/715
4,922,980 5/1990 Parker ..... 150/165
4,947,984 8/1990 Kaufman et al. ..... 206/44.12

*Primary Examiner*—Edgar S. Burr
*Assistant Examiner*—Lynn D. Hendrickson
*Attorney, Agent, or Firm*—Richard P. Crowley

[57] ABSTRACT

A foam keyboard and wrist-support and keyboard dust-cover apparatus which comprises a foldable, flat-sheet, generally rectangular, flexible foam sheet material comprised of a plurality of separate foam sections singly die cut from a foam sheet material, to form a plurality of foam sections having short, uncut foam hinges connecting each of the foam sections and adapted to be moved between a wrist-support position in front of a keyboard, with a plurality of the foam sections stackably folded on top of each other, to form a wrist-support pad, and with at least one foam section beneath the front portion of the keyboard, to retain the wrist-support keyboard pad in position, and a keyboard dust-cover protecting position, wherein the stacked, folded, foam support pad is then extended, to form a protective dust cover over the face of the keyboard, and a method of preparing a foam keyboard wrist-support and keyboard dust-cover apparatus which comprises die cutting, in a single die-cutting operation, a generally rectangular, foam-sheet section, to form the foam keyboard wrist-support and keyboard dust-cover apparatus.

14 Claims, 1 Drawing Sheet

FOAM KEYBOARD WRIST SUPPORT AND DUST COVER APPARATUS AND METHOD

BACKGROUND OF THE INVENTION

There are currently available soft, flexible cloth or plastic keyboard covers which fit over the keyboard, such as a typewriter or computer-console keyboard, to protect the keyboard from dirt, dust, oil and spills. In one example, there are soft, flexible, transparent, plastic covers which fit over the keyboard, permitting the use of the keys on the keyboard, which covers are held in place by a self-adhesive strip. Other covers are hard-top-type covers and are designed to snap on or to fit snugly over the keyboard.

There are also for use with keyboards, but particularly for users, such as data-entry clerks, programmers, telephone-order takers, secretaries, writers, editors and other people who regularly use typewriter or computer keyboards, supports which are designed to provide for a wrist support or rest. Such wrist support or rest may comprise a padded or vinyl or urethane-foam wrist rest or support generally placed and adhesively secured directly in front of the keyboard, to prevent Carpal-Tunnel Syndrome, which is a serious ailment associated with the computer age, and which can cause repetitive strain associated with the long use of a keyboard. Carpal-Tunnel Syndrome typically would cause painful inflammation, swelling and numbness of tendons in the wrist and fingers and possible damage to the hands, nerves and muscles. Some wrist supports provide for flexible foam pads, which may be flat or contoured, to support the wrist in the proper alignment during use of the keyboard. Such foam pads may be placed on a separate plastic stand or may be secured adhesively to the front of the keyboard, employing a double-stick adhesive tape.

It is desired to provide for a new and improved keyboard wrist or rest support and combined keyboard dust-cover apparatus which is effective in one position for preventing Carpal-Tunnel Syndrome, and which, in another position, may be employed as a keyboard dust cover, and which apparatus is simply and inexpensively manufactured and used.

SUMMARY OF THE INVENTION

The invention relates to a foam keyboard rest or wrist support and a keyboard dust-cover apparatus in combination, and to a method of preparation and use. A unique and simple foam keyboard wrist support and keyboard dust-cover apparatus has been found which may be prepared easily and simply by a single die-cutting and folding a sheet of a flexible foam material between a wrist-support-pad position and a dust-cover position.

The apparatus includes a generally rectangular, foldable, flat sheet of a flexible foam material, such as of vinyl, urethane or an expanded olefin, like expanded, extruded polyethylene, composed of a plurality of generally separate, foldable foam sections. The sections are foldable relative to each other and generally are separated by defined cut lines, so that the separate foam sections are adapted to move, by foam hinges in the material, between a wrist- or rest-support position in front of a keyboard and a dust-cover position extending over the face of the keyboard for protective purposes.

The apparatus provides a simple, but effective, support or rest position, and is comprised of a plurality of the foam sections which are stackably folded on top of each other, to form a wrist- or rest-support pad of the proper height, typically ¾ths of an inch to 1½ inches, for the user of the keyboard, and with at least one foam section positioned beneath the forward legs or forward portion of the keyboard, so as to retain the folded wrist-support pad in a secure position in front of the keyboard. The apparatus provides for the foldable, flexible foam material, containing at least the four foam sections, to be unfolded from the wrist-support-pad position, and extend upwardly over the top face of the keyboard, so that a plurality of at least three pads are aligned, to form a protective cover over the top face of the keyboard, while the remaining pad may remain fixed beneath the keyboard, to secure the dust cover in position. The foldable, flexible, foam sheet material is easily moved between the wrist- and rest-support-pad position and the dust-cover position by the user, once one foam section has been secured beneath the forward portion of the keyboard. In addition and helpfully, the one foam section beneath the forward section of the keyboard also provides for a cushioning effect for the keyboard and, if required, for dampening the sound of the keyboard.

The flexible foam sheet material, which generally forms a plurality of separate, foldable foam sections, should be of sufficient length so that, in the keyboard dust-cover protective position, the foam sheet material will extend over the keyboard and protect the keyboard, and, while in the wrist-support position, the pads may be aligned as desired in sufficient height.

The flexible foam material may be comprised of a variety of soft, flexible, support foam material, and may include, but not be limited to, a vinyl foam, a urethane foam, and more particularly an expanded olefinic foam, such as a wear-resistant, expandable polyethylene, such as a cross-linked, soft, flexible, polyethylene foam; for example, having a foam density ranging from about 2 to 12 pounds per cubic foot; for example, 4 to 8 pounds per cubic foot, and which, optionally, may have a thin film of plastic material secured to one or both surfaces, such as, for example, optionally an extruded thin film of 10 to 30 mils of a polyethylene film material, to provide additional strength to the foam sheet material. Typically and preferably, the foam sheet material comprises an expanded, cross-linked, flexible, polyethylene, foam sheet material, which may be die cut easily and of low foam density, so as to form a plurality of uncut foam-type hinges for each section, so that the foam sheet material may be folded readily between the wrist-support and the dust-cover position. The foam sheet material may range in thickness from ⅛th to ½ inch, depending upon the desired height of the resulting wrist-support pad. Where applicable and necessary, the expanded foam sheet material may include antistatic-type additives, such as carbon black, or a a bottom antistatic-type pad sheet material thereto, in order to provide for reduction in static and permit the grounding of static charges which are built up by the user.

The foam keyboard, wrist-support and dust-cover apparatus is easily and simply manufactured by providing a generally rectangular, flexible, foam sheet material of low density with a single die cutting forming the foam sections, and to provide uncut areas therein, which foam areas act as hinges. The invention also concerns the combination of the foam keyboard wrist-support and dust-cover material with a computer, typewriter or other type keyboard, with the foam sheet material in a wrist-support-pad position in front of the keyboard, and in a dust-cover position over the top of the keyboard.

The invention will be described for the purposes of illustration only, in connection with certain embodiments; however, it is recognized that those persons skilled in the art may make various changes, modifications, additions and improvements to the illustrated embodiments, without departing from the spirit and scope of the invention.

DESCRIPTION OF THE EMBODIMENTS

Figure 1:
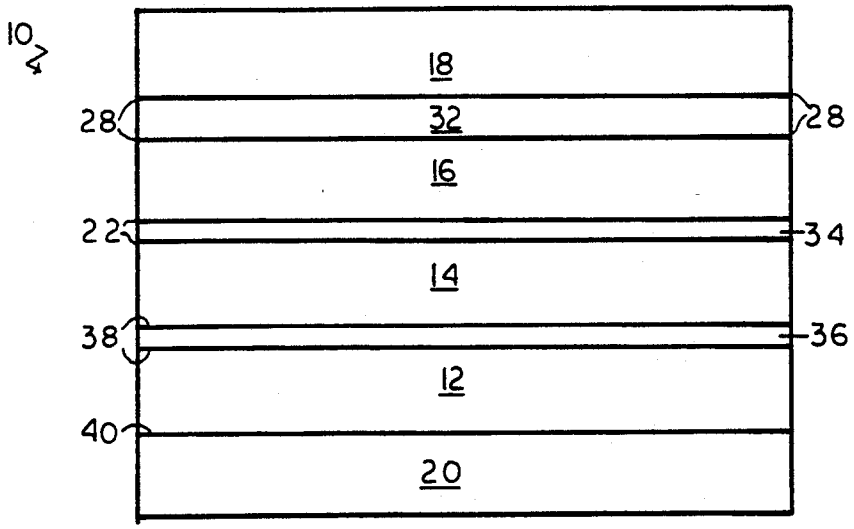
FIG. 1 is a top plan view of the foam keyboard wrist-support and keyboard dust-cover foam sheet in a flat position after manufacture.

FIG. 1 shows a foam keyboard wrist-support and dust-cover apparatus 10 composed of a first fold section 12, a second fold section 14, a third fold section 16 a fourth fold section 18 and a fifth fold section 20 and sections 32, 34 and 36 composed of a ¼th of an inch extruded, cross-linked, flexible, polyethylene foam material, having a closed-cell foam density of from about 4 to 8 pounds. The foam sections have been formed by a die-cutting operation, by die cutting sections 12 and 14 along die-cut lines 38 leaving short, foam section 36. Between foam sections 14 and 16, there are generally parallel die-cut lines 22, to form foam sections 34 of short length, the die-cut lines 22 about the width of the foam sheet material, to provide for foldable foam sections 14 and 16. Between foam sections 16 and 18, there are die-cut lines 28 generally parallel, to form a foam hinge section 34, which is generally twice the width of the foam sheet material. Thus, between foam sections 16 and 18, there is a short-width foam section 32, and, between foam sections 14 and 16, a short-width foam section 34 half the width of 32 and between sections 12 and 14, a short width foam section 36 of the same width as section 34. A single die-cut line 40 separates sections 20 and 12, so as to permit the proper folding of the foam-sheet section between the foam keyboard wrist-support-pad position and the dust-cover position. The single die cut permits the simple and inexpensive manufacture of the apparatus of the invention, and the die cutting with the foam strips 32 and 34 permits the foam sheet 10 to be used both as a wrist support and a dust cover.

Figure 2:
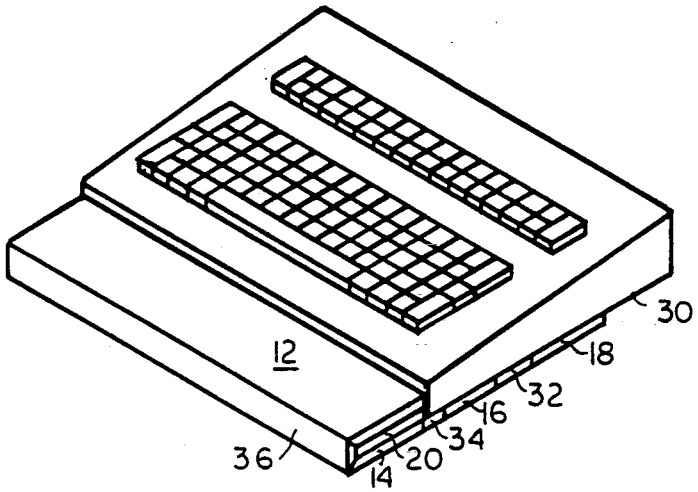
FIG. 2 is a perspective view from above, showing the foam keyboard wrist support as a folded pad in front of a keyboard.

FIG. 2 is a perspective view showing the sheet apparatus 10 in a keyboard wrist-support position, wherein, as illustrated there is shown a keyboard 30, wherein the foam sections 18, 32, 16 and 34 are positioned under the keyboard 30, to retain the support in the desired position, and also, incidentally, to provide, if desired, a dampening and cushioning effect for the keyboard 30. The remaining folds 14, 16 and 18 are folded over on each other, as illustrated, to form a flat, stacked, flexible foam which extends generally the length of the keyboard, for use in supporting the wrist of the keyboard user, thereby preventing wrist and lower-arm fatigue.

Figure 3:
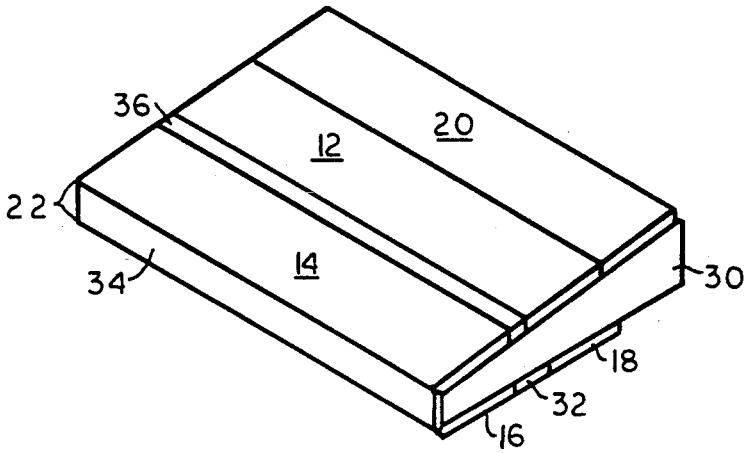
FIG. 3 is a perspective view from above, showing the foam keyboard wrist support and dust cover extended to act as a dust cover over the face of the keyboard.

FIG. 3 is a perspective illustration of the foam-sheet apparatus in a folded, dust-cover position, wherein the folded up hinged foam sections 20, 12, 36 and 14 have been unfolded and placed over the face of the keyboard, to provide for dust, dirt and spill protection for the keyboard, with the foam section 32 serving as a face, to protect the vertical face of the keyboard, and to permit a better fit for the foam keyboard dust cover, and to permit the foam sheet to move between the wrist-support-pad and the dust-cover positions.

Thus, there is provided a simple, effective and inexpensive foam keyboard wrist support and dust-cover apparatus and a method of preparing and using the apparatus.

What is claimed is:

1. A foam wrist-support and dust-cover apparatus for use with a keyboard having a front section and a face surface to provide wrist support for a keyboard user in a wrist support position and a dust cover for the keyboard in a protective dust cover position, which apparatus comprises:

a generally rectangular, foldable, flat sheet of flexible foam material composed of a plurality of separate, adjacent foam sections, each foam section separated by cut lines in the foam sheet material, to form a plurality of foam hinges in the sheet material between the foam sections, and to render the separate foam sections foldable, with respect to each other, the sheet of foam material having a width which extends substantially the length of the keyboard, and a length sufficient to extend from the front surface of the keyboard over the face of the keyboard, to serve as a protective dust cover, the foam sheet material adapted to move between a wrist-support position in front of a keyboard, with a plurality of the foam sections stackably folded on top of each other, to form a wrist-support for the user of the keyboard, and with at least one end foam section secured beneath the front portion of the keyboard, to retain the foam sheet material in position, and a keyboard dust-cover position, wherein the foam sections are extended in sheet form over the face surface of the keyboard, to form a protective dust cover, and with at least one end foam section beneath the front section of the keyboard, to retain the protective dust cover in position.

2. The apparatus of claim 1 wherein the foam sheet material comprises an expanded, polyethylene foam sheet material.

3. The apparatus of claim 1 wherein the apparatus in the wrist-support position comprises a plurality of foam sections beneath the keyboard and at least three, folded-over foam sections folded to form a wrist support in front the keyboard.

4. The apparatus of claim 1 wherein the apparatus in the dust-cover protective position comprises a plurality of foam sections extending beneath the keyboard, and the remaining foam sections extending upwardly from the front of the keyboard and over the face of the keyboard.

5. The apparatus of claim 1 wherein the foam sheet material has a thickness of from about ⅛th to ⅜ths of an inch, and has a foam density which ranges from about 2 to 12 pounds per cubic foot.

6. The apparatus of claim 1 wherein the foam sheet material includes, on at least one surface thereof, an extruded, thin-film sheet material having a thickness ranging from about 10 to 30 mils.

7. The apparatus of claim 1 which includes a short foam section between two wider foam sections, one of which wider foam sections is an end foam section, and which short foam section has a width of about twice the thickness of the foam sheet material.

8. The apparatus of claim 1 which includes an expanded, cross-lined, polyethylene foam sheet material having a density of from about 2 to 12 pounds per cubic foot.

9. In combination, a keyboard with the apparatus of claim 1, wherein the apparatus comprises a wrist-support in front of the keyboard.

10. In combination, a keyboard with the apparatus of claim 1, wherein the apparatus comprises a protective dust cover of generally aligned foam sections, extending over the face of the keyboard.

11. A method of preparing a foam keyboard wrist-support and keyboard dust-cover apparatus for use with a keyboard having a front section and a face surface to provide wrist support for a keyboard user in a wrist support position and a dust cover for the keyboard in a protective dust cover position, which method comprises:

a) providing a generally rectangular, flexible, foam sheet material; and b) die cutting the sheet material to form a plurality of separate foam sections, each foam section separated by a die-cut line in he foam sheet material to form a plurality of separate, adjacent foam sections separated by generally parallel die-cut lines to form a plurality of foam hinges in the sheet material between the foam sections and to render the separate foam sections adapted to move between a wrist-support position in front of a keyboard, with a plurality of the foam sections stackably folded on top of each other, to form a wrist-support for the user of the keyboard, and with at least one end foam section secured beneath the front portion of the keyboard, to retain the foam sheet material in position, and a keyboard dust-cover position, wherein the foam sections are extended in sheet form over the face surface of the keyboard to form a protective dust cover, and with a least one end foam section beneath the front section of the keyboard to retain the protective dust cover in position.

12. The method of claim 11 wherein the foam sheet material is die cut in a single operation, and which sheet material comprises an expanded, polyethylene foam sheet material having a closed-cell foam density of about 2 to 12 pounds per cubic foot.

13. The apparatus prepared by the method of claim 11.

14. The method of claim 11 wherein the foam sheet material includes an extruded film of polyethylene secured to one surface of the foam sheet material.

* * * * *